US006572221B1

(12) United States Patent
Harvey et al.

(10) Patent No.: US 6,572,221 B1
(45) Date of Patent: Jun. 3, 2003

(54) DROPLET DEPOSITION APPARATUS FOR INK JET PRINTHEAD

(75) Inventors: Robert Alan Harvey, Cambridge (GB); Giuseppe Mario Lombardi, Swavesey (GB); Salhadin Omer, Cambridge (GB); Stephen Temple, Cambridge (GB)

(73) Assignee: XAAR Technology Limited, Cambridge (GB)

( * ) Notice: Subject to any disclaimer, the term of this patent is extended or adjusted under 35 U.S.C. 154(b) by 0 days.

(21) Appl. No.: 09/238,378

(22) Filed: Jan. 27, 1999

Related U.S. Application Data

(63) Continuation of application No. PCT/GB98/03050, filed on Oct. 9, 1998.
(60) Provisional application No. 60/073,041, filed on Jan. 29, 1998.

(30) Foreign Application Priority Data

Oct. 10, 1997 (GB) ..... 9721555

(51) Int. Cl.[7] ..... B41J 2/045
(52) U.S. Cl. ..... 347/68
(58) Field of Search ..... 347/68, 69, 70, 347/71, 84, 85, 89, 47

(56) References Cited

U.S. PATENT DOCUMENTS

| | | | | | |
|---|---|---|---|---|---|
| 4,432,003 | A | * | 2/1984 | Barbero et al. | 347/89 |
| 4,568,953 | A | | 2/1986 | Aoki et al. | |
| 4,611,219 | A | | 9/1986 | Sugitani et al. | |
| 4,727,378 | A | * | 2/1988 | Le et al. | 347/89 X |
| 4,835,554 | A | * | 5/1989 | Hoisington et al. | 347/89 |
| 5,432,540 | A | | 7/1995 | Hiraishi | 347/69 |
| 5,463,414 | A | * | 10/1995 | Temple et al. | 347/69 X |
| 5,631,680 | A | * | 5/1997 | Sugahara | 347/69 |
| 5,678,290 | A | | 10/1997 | Good | 29/25.35 |
| 5,719,606 | A | | 2/1998 | Kigawa et al. | 347/69 |
| 5,958,122 | A | * | 9/1999 | Fukuda et al. | 347/84 X |
| 6,042,219 | A | * | 3/2000 | Higashino et al. | 347/47 |

FOREIGN PATENT DOCUMENTS

| | | |
|---|---|---|
| DE | 24 29 232 | 1/1976 |
| DE | 39 17 434 A1 | 11/1989 |
| EP | 0 364 136 A2 | 4/1990 |
| EP | 0 485 241 A1 | 5/1992 |
| EP | 0 575 983 A2 | 12/1993 |
| EP | 0 595 654 A2 | 5/1994 |
| EP | 0 627 315 A2 | 12/1994 |
| EP | 0 628 413 B1 | 12/1994 |
| EP | 0 655 334 A1 | 5/1995 |
| EP | 0 723 869 A2 | 7/1996 |
| EP | 0 767 061 A2 | 4/1997 |
| GB | 2 288 765 | 11/1995 |
| JP | 06-246914 | 6/1994 |
| JP | 07-025010 | 1/1995 |
| JP | 07-032612 | 2/1995 |
| JP | 07-137251 | 5/1995 |
| JP | 07-266555 | 10/1995 |
| JP | 09-094952 | 4/1997 |
| WO | WO 91/17051 | 11/1991 |
| WO | WO 92/10367 | 6/1992 |
| WO | WO 95/25637 | 9/1995 |

* cited by examiner

*Primary Examiner*—Raquel Yvette Gordon
*Assistant Examiner*—Charlene Dickens
(74) *Attorney, Agent, or Firm*—Marshall, Gerstein & Borun

(57) ABSTRACT

A piezoelectric printhead or other droplet deposition apparatus has parallel liquid containing channels defined by a base and displaceable walls, and covered by a cover number. The channels each have at least one nozzle for ejecting droplets. Each nozzle may be disposed in the base, the cover then having two ink supply parts spaced lengthwise of each channel on opposite sides of the nozzle. Alternatively two longitudinally spaced nozzles may be provided in the base of each channel. The cover may have a conductive track corrected to wall-displacing electrodes, the points of connection being outside the channels.

42 Claims, 10 Drawing Sheets

DROPLET DEPOSITION APPARATUS FOR INK JET PRINTHEAD

This is a continuation of International Application No. PCT/GB98/03050 filed Oct. 9, 1998. The priority benefit under 35 U.S.C. §119(e) of provisional application No. 60/073,041 filed Jan. 19, 1998 is claimed.

FIELD OF THE INVENTION

The present invention relates to droplet deposition apparatus, in particular an inkjet printhead, which comprise a channel communicating with a supply of droplet liquid and an opening for ejection of droplets therefrom, at least one channel side wall being displaceable in response to electrical signals, thereby to effect ejection of droplets from the channel.

BACKGROUND OF THE INVENTION

FIG. 1*a* is a cross-sectional view of the channels of the prior art inkjet printhead construction according to WO92/22429. Piezoelectric ceramic sheet 12 is poled in its thickness direction 17 and formed in one surface with channels 11 bounded on two sides lying parallel to the channel axis by channel walls 13. By means of electrodes 23 formed on either side of each wall 13, an electric field can be applied to the piezoelectric material of the walls, causing them to deflect in shear mode in a direction transverse to the channel axis. Pressure waves are thereby generated in the ink which result in the ejection of an ink droplet. These principles are known in the art, e.g. from EP-A-0 364 136.

Channels 11 are closed along one side lying parallel to the channel axis by the surface of a cover 14 having conductive tracks 16 at the same pitch interval as the ink channels formed thereon. Solder bonds 28 are formed between tracks 16 and the channel wall electrodes 23, thereby securing the cover to the base and creating an electrical connection between the electrodes and the track in a single step. To protect them from later being corroded by the ink, electrodes and tracks are then given a passivant coating.

As shown in FIG. 1*b*, which is a sectional view taken along the longitudinal axis A of a single channel of the prior art printhead of FIG. 1*a*, a nozzle plate 20 having respective ink ejection nozzles 22 is mounted at the front of the sheet 12 whilst an ink manifold 26 is defined at the rear by a manifold structure 21. Tracks 16 are led to the rear of cover 14 for connection to a drive circuit, typically embodied in a microchip 27 which in turn is driven by signal received via input tracks 18.

In printheads of this ilk, the channel walls and in particular the electrodes formed thereon—are often passivated so as to protect from subsequent corrosion by the ink. Reference is made in this regard to WO95/07820.

In the device discussed above, however, such conventional passivation prior to attachment of the cover would inhibit the formation of solder bonds between the electrodes and the tracks. On the other hand, passivation after the cover has been attached can only be applied from the end of the channel, resulting in low quality coating of the electrodes and tracks, especially at the midpoint of the channel remote from the channel ends.

SUMMARY OF THE INVENTION

The present invention has as an objective a printhead construction that retains the connection advantages associated with the conductive tracks formed on the cover of the prior art construction and yet is amenable to passivation.

Accordingly, the present invention consists in one aspect in droplet deposition apparatus comprising at least one channel having means for communicating with a supply of droplet liquid and an opening for ejection of droplets;

the channel being bounded on at least one side lying parallel to the channel axis by a channel wall associated with actuator means; the actuator means effecting displacement of the channel wall in response to electrical signals, thereby to effect ejection of droplets from the channel;

the channel being bounded on a further side lying parallel to the channel axis by a cover surface, the cover surface having formed thereon at least one conductive track for conveying electrical signals to said actuator means, the point of electrical connection between the track and the actuator means lying outside the channel.

Since the sole point of electrical connection between the track and the actuator in accordance with the present invention lies outside of the channel and thus out of contact with the ink (with its potentially corrosive effects), passivation of this point is no longer required. The channel itself can therefore be conventionally passivated via the open tops of the channels, thereafter, the cover can be attached and electrical contact established between the conductive tracks on the cover and the actuator means associated with the channel walls. Even in a printhead that—because of the type of ink it is designed to fire—does not require passivation, a point of electrical connection lying outside the channel as per the present invention is less likely to fail in fatigue than the channel-length solder bonds of the prior art device of FIGS. 1*a*, 1*b*.

A corresponding method according to a first aspect of the invention consists in a method of manufacture of droplet deposition apparatus method of manufacture of droplet deposition apparatus, the method comprising the steps of:

forming in a base component at least one open-topped channel and, bounding said channel on at least one side lying parallel to the channel axis, a channel wall associated with actuator means for effecting displacement of the channel wall in response to electrical signals, thereby to effect ejection of droplets from the channel;

closing the channel on a further side lying parallel to the channel axis by a cover surface, the cover surface having formed thereon at least one conductive track for conveying electrical signals to said actuator means; and electrically connecting the conductive track and the actuator means at a point lying outside the channel.

Advantageously, the step of closing the channel results in the electrical connection of the conductive track and the actuator means, thereby simplifying the manufacturing process.

The first aspect of the invention also consists in droplet deposition apparatus comprising: a bottom sheet of piezo-material poled droplet deposition apparatus comprising:

a bottom sheet of piezo-material poled in a direction normal to said sheet and formed with a multiplicity of parallel, open-topped channels mutually spaced in an array direction normal to the length of the channels and defined each by facing side walls and a bottom surface extending between said side walls;

a top sheet facing said bottom surfaces of said channels and bonded to said side walls to close said channels at the tops thereof;

respective nozzles communicating with said channels for the ejection of droplets of liquid therefrom;

connection means for connecting said channels with a source of droplet deposition liquid;

wherein each channel is formed with a forward part in which electrodes are provided on opposite sides of at least one of the side walls defining the channel, thereby to form a shear mode actuator for effecting droplet expulsion from the channel; and wherein each channel is formed with a rearward part having an electrically-conductive coating which is in electrical contact with the at least one electrode on the channel-facing sides of the side walls in the forward part;

sealing means separating the forward part from the rearward part; and wherein the apparatus further comprises conductive tracks formed on that surface of said top sheet that is bonded to said side walls, the conductive tracks being in electrical contact with the electrically-conductive coating in said rearward part.

A corresponding method comprises the steps of forming a bottom sheet with a layer of piezo-material poled in a direction method of manufacture of a droplet deposition apparatus comprising the steps of:

forming a bottom sheet with a layer of piezo-material poled in a direction normal to said sheet;

forming a multiplicity of parallel, open-topped channels mutually spaced in an array direction normal to the length of the channels, each channel being defined by facing side walls and a bottom surface extending between said side walls, each channel further having a forward part and a rearward part;

forming electrodes on opposite sides of at least one of the side walls defining the forward part of each channel, thereby to form a shear mode actuator for effecting droplet expulsion from the channel; and forming in the rearward part of each channel an electrically-conductive coating in electrical contact with a respective electrode;

providing a top sheet having a surface formed with conductive tracks thereon; and bonding that surface of the top sheet having conductive tracks thereon to said side walls so as to close said channels at the tops thereof;

establishing electrical contact between said tracks and the respective electrically-conductive conductive coating of each channel; and providing sealing means separating the forward and rearward parts of each channel.

A second aspect of the present invention consists in droplet deposition apparatus comprising droplet deposition apparatus comprising:

at least one longitudinal, open-topped droplet liquid channel defined by facing longitudinal side walls and a bottom, longitudinal surface extending between the side walls;

means for applying an electric field to piezoelectric material in at least one of said walls, thereby to effect displacement of the wall relative to said longitudinal channel so as to eject a droplet from the channel; and a cover closing the open, longitudinal top side of the channel;

wherein said bottom longitudinal surface of the channel is formed with an opening for droplet ejection, and;

the cover incorporates two ports for supply of droplet liquid, the ports being spaced along the channel on either side of the opening.

Such a construction again simplifies the manufacture of known printheads, particularly those of the "top shooter" kind discussed in WO91/17051. FIG. 2 shows a sectional view along the channels of such a prior art printhead, with those features that correspond to FIG. 1 being denoted by corresponding reference numbers. Droplet ejection takes place from a nozzle 22 formed in the channel cover component 60 whilst droplet liquid is supplied to the channel via ports 33 formed in the channel base and which are typically connected in their turn to ink supply conduits (not shown) formed in a base component 35 that is separate from the piezoelectric channeled component 12.

In accordance with the invention, an opening communicating with a droplet ejection orifice is formed in the bottom surface of the channel, thereby allowing the cover component to incorporate ports for supply of ink into the channel. A further, separate base component is consequently no longer required.

A third aspect of the invention comprises droplet deposition apparatus comprising:

at least one longitudinal, open-topped droplet liquid channel defined by facing longitudinal side walls and a bottom, longitudinal surface extending between the side walls;

means for supplying droplet liquid to the channel;

means for applying an electric field to piezoelectric material in at least one of said walls, thereby to effect displacement of the wall relative to said longitudinal channel so as to eject a droplet from the channel; and a cover closing the open, longitudinal top side of the channel;

wherein the bottom longitudinal surface of the channel is formed with two openings for droplet ejection, the openings being spaced along the channel.

Such a construction brings to the arrangement of PCT application no. PCT/GB98/01495 the aforementioned advantage of reduced component count.

Corresponding method claims are also comprised in the present invention, and other aspects are as set out in other independent claims.

Further advantageous embodiments of the invention are set out in the description, drawings and dependent claims.

The disclosure of all claims is deemed incorporated here as consistory clauses, unless already set out above.

The invention will now be described by way of example by reference to the following diagrams, of which:

DETAILED DESCRIPTION OF THE PREFERRED EMBODIMENTS

Figure 1A:
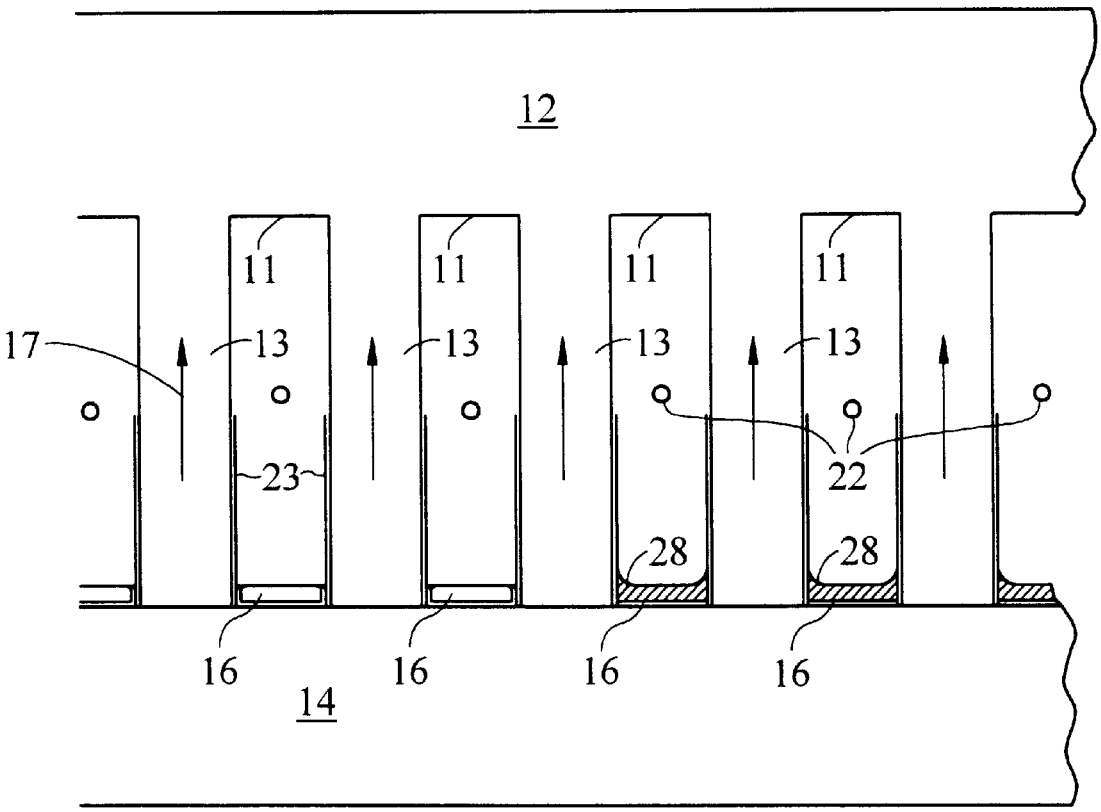
Fig. 1A PRIOR ART
Figure 1B:
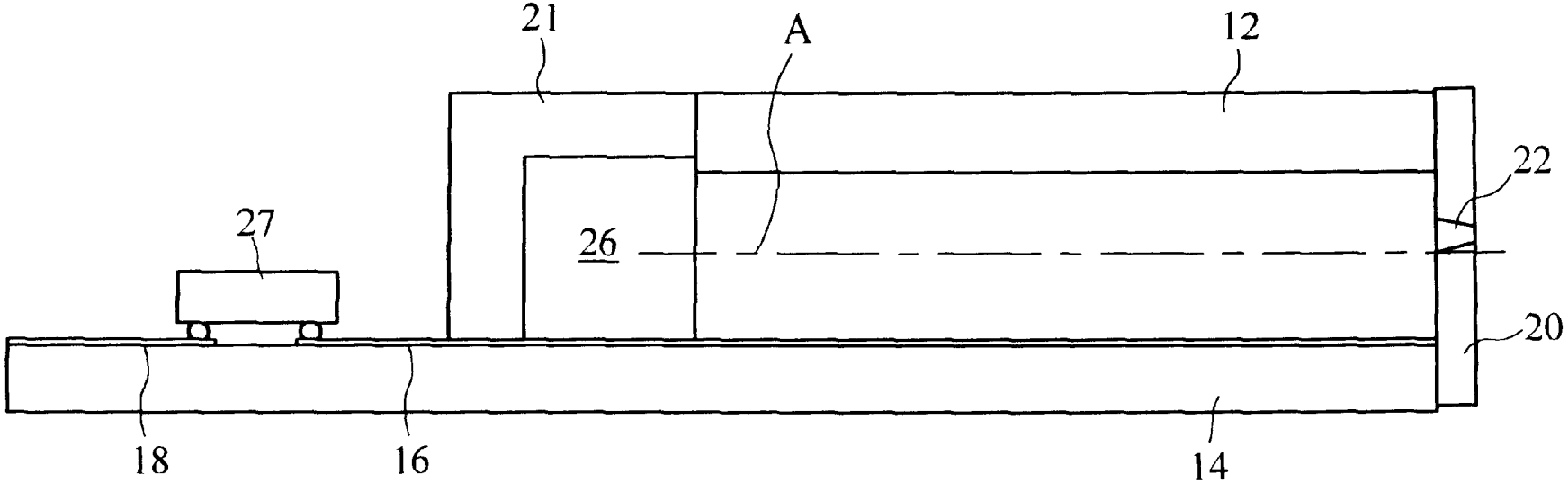
Fig. 1B PRIOR ART
Figure 2:
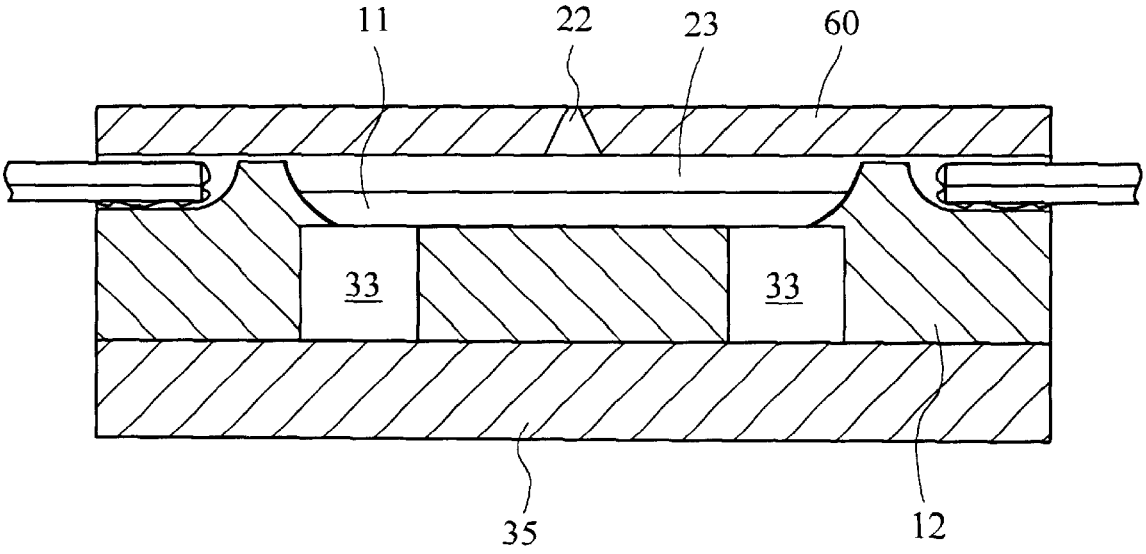
Fig. 2 PRIOR ART
Figure 3:
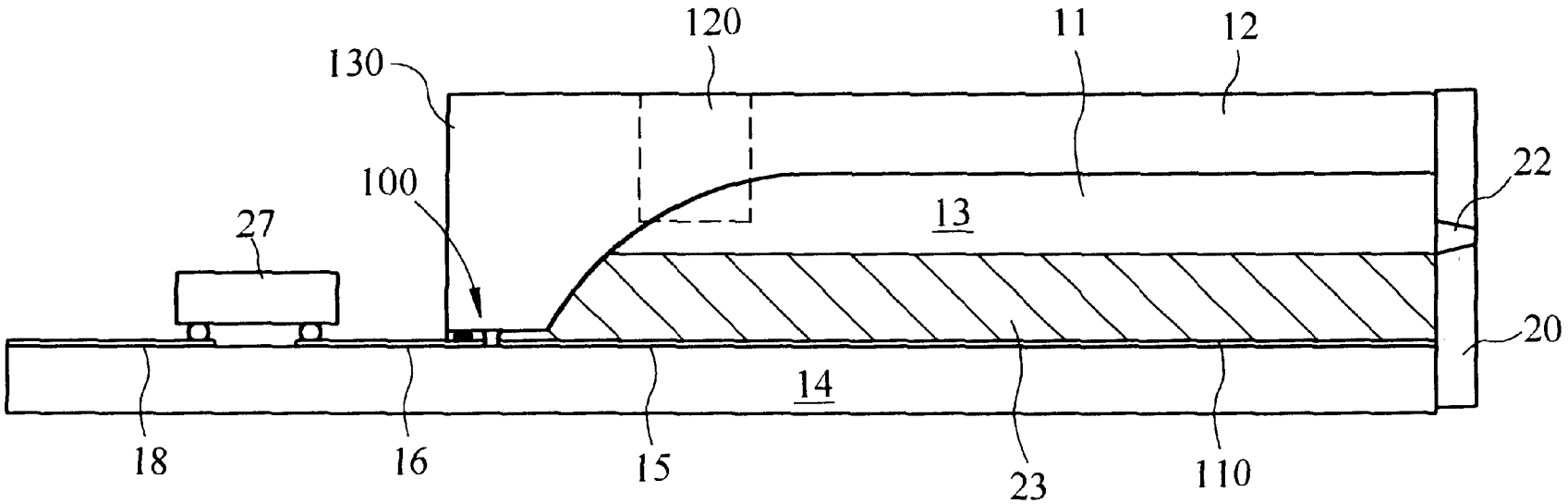
FIG. 3 is a sectional view taken along the channel axis of a printhead according to a first embodiment of a first aspect of the present invention.

FIG. 3 illustrates a printhead according to a first embodiment of the first aspect of the present invention, with those features that are common to FIG. 3 and the prior art printhead of FIGS. 1 and 2 being designated by common reference numerals.

As in the prior art device, a piezoelectric ceramic body 12 poled in the thickness direction is formed with channels 11 separated by channel walls 13. As known from EP-A-0 364 136 referred to above, electrodes 23 are formed along each wall 13 in the ink-containing channel 11 as well as extending along a rearward groove 100 to the rear face 130 of the body. In addition, there is provided a cover 14, a surface 15 of which closes the open side of each of the channels 11, a nozzle plate 20 with nozzles 22 for droplet ejection and a manifold for supply of ink into the channel in the form of a transverse cut in the body 12. Surface 15 of cover 14 has tracks 16 formed thereon (suitable processes are well know) which in turn are connected to microchip 27 (which is illustrated figuratively in FIG. 3 and not to scale) which in turn receives input signals from input tracks 18.

Figure 4A:
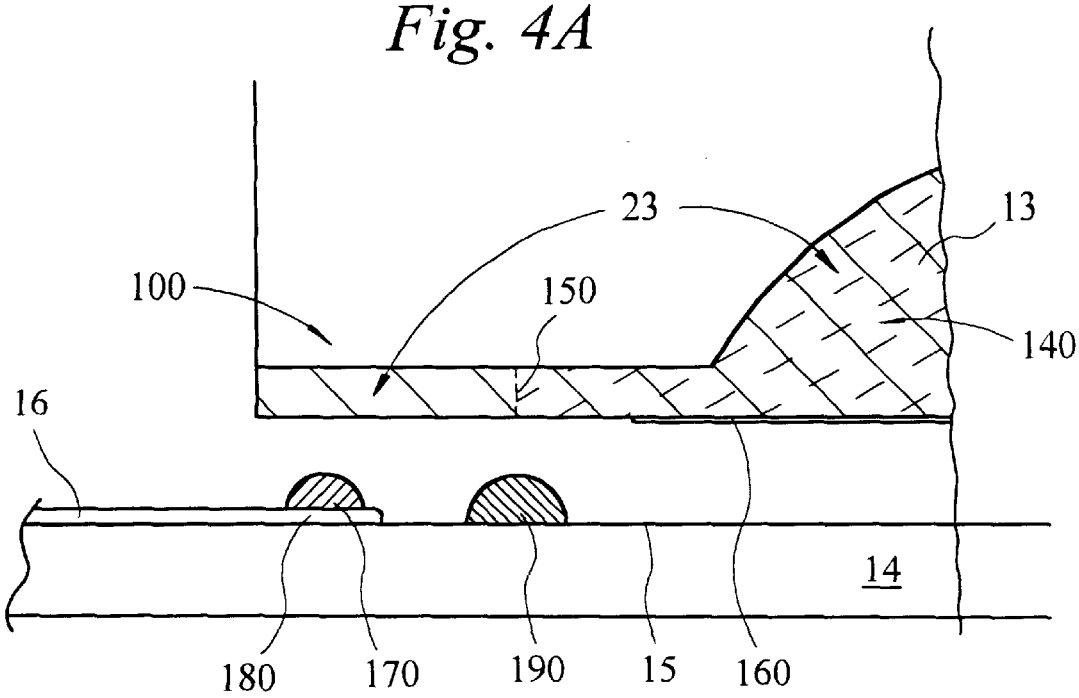
FIGS. 4*a* and 4*b* show detail of the rear part of the printhead of FIG. 3 before and after attachment of the cover respectively.

Detail of the rear part of the printhead prior to attachment of the cover is shown in FIG. 4*a*: a passivation layer 140 (not shown in FIG. 3 but indicated by dashed hatching in FIG. 4*a*) is applied over the entirety of the electrodes 23 (indicated by solid hatching in both FIGS. 3 and 4*a*) in the channel and part way along the rearward groove 100. In contrast to the prior art construction, passivation is carried out before attachment of the cover and advantageously according to the method described in WO95/07820.

Figure 4B:
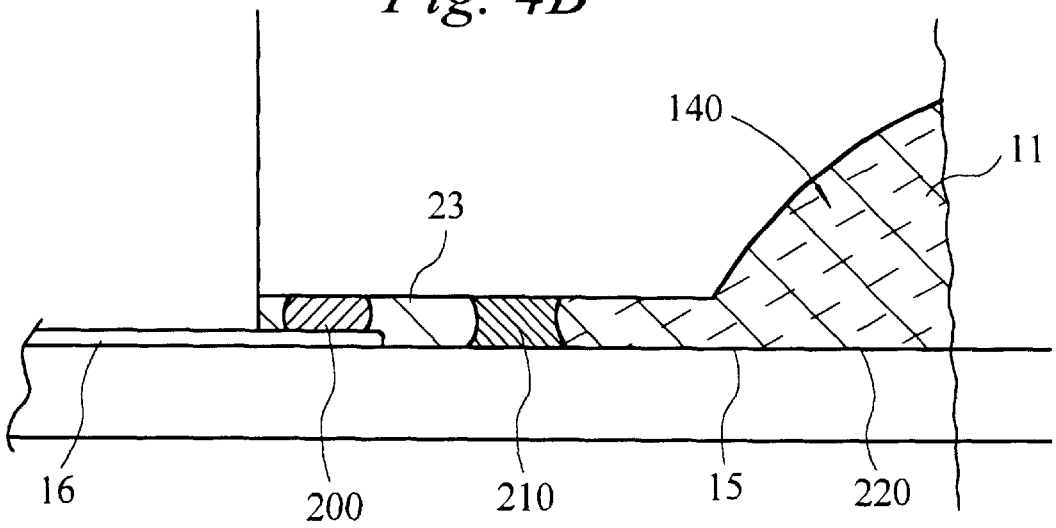

A mechanical bond between body and surface 15 of cover 14 is achieved by means of adhesive layer 160, applied to the end surfaces of the walls 13 in the region of the channels 11 prior to assembly of cover and body and preferably in accordance with the method discussed in WO95/04658. FIG. 4*b* illustrates the assembled printhead, with the adhesive bond being indicated at 220. Such a bond may indeed be tougher and have a longer fatigue life than the corresponding solder bond of the prior art construction described above.

Electrical connection between the conductive tracks 16 on the cover and that part of the electrode 23 in the rearward groove 100 is achieved by a protrusion 170 of a malleable, deformable, conductive material such as solder affixed to the end 180 of track 16. On assembly of the cover to the body, as illustrated in FIG. 4*b*, protrusion 170 comes into contact with electrode 23 and is deformed, thereby providing an effective electrical contact 200 between electrode 23 and track 16.

A bead 190 of a sealing paste or high viscosity glue is also applied so as to form on assembly an ink seal 210 between the end of the ink channel 11 and the electrical contact 200. Such a seal protects the electrical contact from later corrosion by ink. Preferably, the seal is positioned so as to straddle the free end 150 of the passivation layer 140, thereby preventing the seepage of ink under the passivation layer from where it might otherwise attack the electrode material 23.

Figure 5:
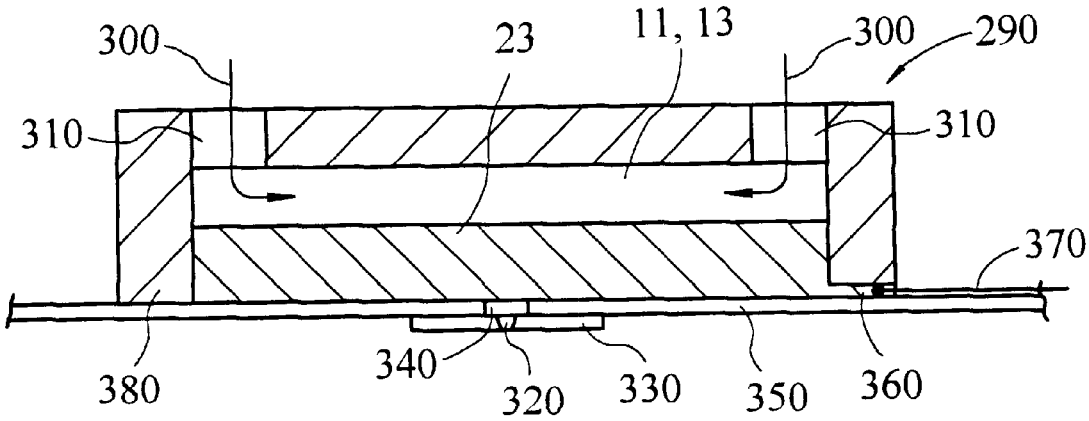
FIG. 5 is a sectional view taken along the channel axis of a printhead according to a second embodiment of a first aspect of the present invention.

FIG. 5 illustrates a second embodiment of the first aspect of the present invention. A ceramic piezoelectric body 290 is, as in the previous embodiment, poled in the thickness direction and formed with channels 11 separated by channel walls 13 which in turn have an electrode 23 formed on each side. Ink ejection, however, takes place from a centrally located nozzle 320 formed either directly in the cover 350 or, as shown, in a nozzle plate 330 communicating with the channel via an aperture 340 formed in the cover. Body 290 is additionally formed with two manifolds 310 for supply of ink from both ends of the channel, as indicated by the arrows 300. A further structure (not shown) will supply the manifolds with ink from a reservoir.

Such a "double-ended" printhead configuration is disclosed in WO91/17051 and has advantages in terms of a lower operating voltage over the "single-ended" configuration described above. Furthermore, the configuration of base 290 is suited to manufacture by moulding—a technique that is potentially more attractive from the point of view of manufacturability than conventional sawing techniques described in the aforementioned EP-A-0 364 136.

The connection of the channel electrode 23 to conductive tracks 370 formed on that surface of cover 350 facing body 290 is as already described with regard to FIGS. 3, 4*a* and 4*b*, however, and is located in groove 360 formed at one side of the body 290. Similarly, in the region of the channel itself (the channel walls of which are passivated prior to assembly) and at that end 380 of the body not occupied by an electrical connection, cover 350 is attached to the piezoelectric ceramic body by a conventional adhesive bond (not shown).

In order to minimise the distance traveled by the ink from the channel proper 11 to the outlet of the nozzle 320—thereby reducing pressure losses and consequent reductions in droplet ejection velocity—the nozzle 320 may be formed in the cover 350 itself. Advantageously the nozzle is formed by laser ablation as described, for example, in WO93/15911, and to this end the cover may be made of an easily ablatable material, suitably a polymer such as polyimide, polycarbonate, polyester or polyetheretherketone, typically of 50 $\mu$m thickness.

The stiffness of a cover plate formed of such an easily ablatable material may be increased by application of a coating of stiffer material to the inner and outer surfaces of the ablatable cover plate. Particularly suitable for this purpose is silicon nitride: it can also be used as a passivant coating in the process of the aforementioned WO95/07820, is deposited as a smooth coating suitable for the subsequent application of a non-wetting coating, and will not short out electrodes of adjacent channels due to its non-conducting properties. Two layers of such a material placed either side of the polyimide cover and each having a thickness of around 5% of that of the cover (2.5 $\mu$m in the case of a 50 $\mu$m thick cover) will typically increase bending stiffness by a factor of 5–10 (based on standard compound beam theory and assuming a value of Young's Modulus for the stiffening material approximately 100 times greater than that of the polymer and good adhesion between the stiff and polymer materials). Such a thin layer has no significant effect on the ease with which the cover plate can be ablated to form a nozzle, particularly if the material of the layer itself is to some degree ablatable.

Expressed in broad terms, the cover plate for an inkjet printer comprises a layer of a first, easily ablatable, material having further layers bonded on opposite sides thereof, the further layers each being of a material having a stiffness at least an order of magnitude greater than that of the first material and being of a thickness at least an order of magnitude less than that of the first layer.

Figure 6:
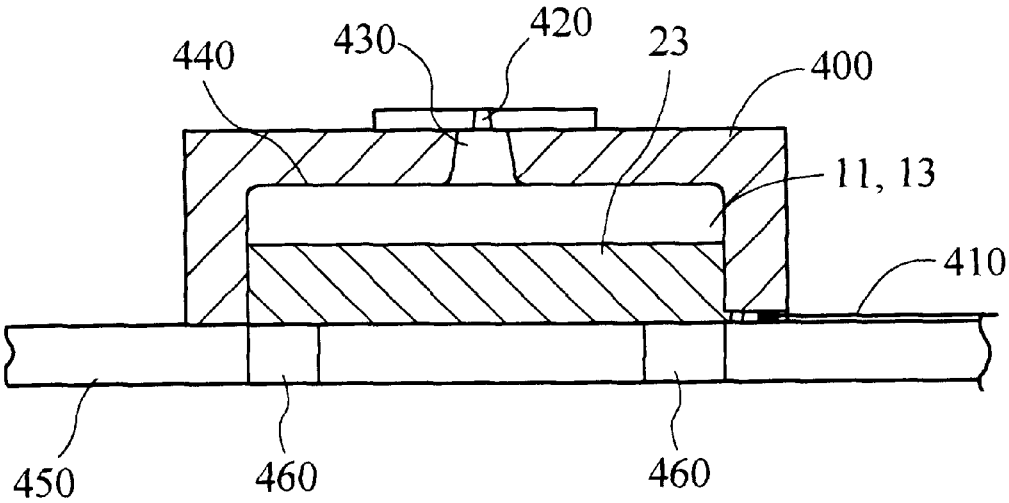
FIG. 6 is a sectional view taken along the channel axis of a printhead incorporating both first and second aspects of the present invention.

Referring now to FIG. 6, there is shown a printhead incorporating both first and second aspects of the present invention. Piezoelectric ceramic body 400 is formed with channels 11, channel-separating walls 13 and electrodes 23 which are supplied with actuating signals via conductive tracks 410 connected to drive circuitry (not shown). Unlike previous embodiments, however, droplet ejection takes place from a nozzle 420 communicating with an opening 430 formed in the body 400 at the closed, bottom surface 440 of the channel 11—this is in contrast to FIG. 5 where the nozzle 320 is located in a cover 350 closing the open, top side of the channel 11.

Moulding is again the preferred method of manufacture of the channelled body 400, and the arrangement of FIGS. 4*a* and 4*b* is again employed for electrical connection between the electrodes 23 and conductive tracks 410. Communication hole 430 may also be formed during the moulding process or may be formed subsequently, e.g. by means of a laser. Cover 450 no longer incorporates a nozzle but is instead formed with ink inlet ports 460. Such an arrangement has a lower component count than embodiments discussed earlier and has consequential manufacturing advantages. Alternatively, ink supply ports could be formed in the channelled component, e.g. at the channel ends.

Figure 7:
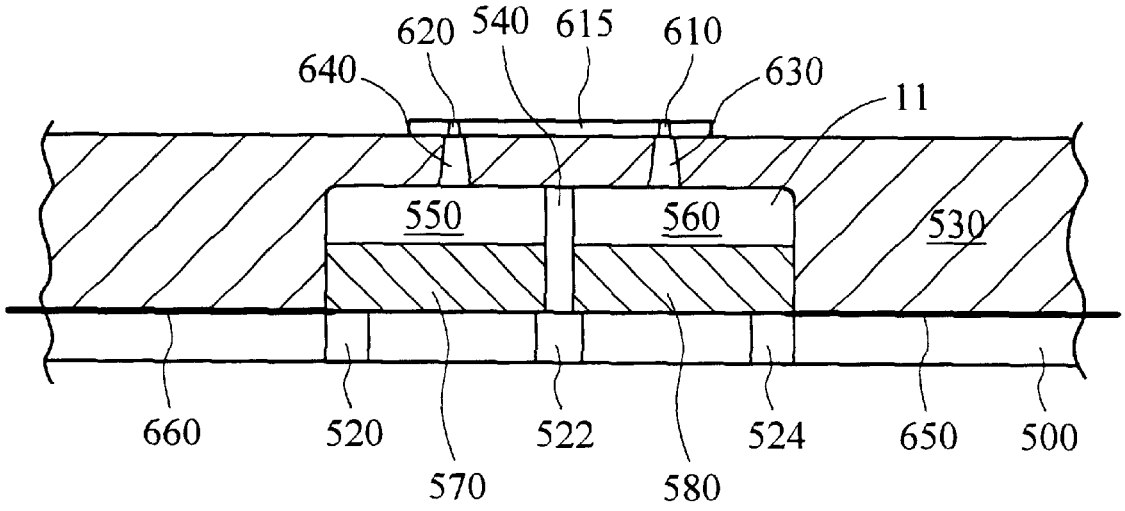
FIG. 7 is a sectional view taken along the channel axis of a printhead according to a second embodiment of a second aspect of the present invention.

The printhead of FIG. 7 also employs a cover component 500 having ink inlet ports 520, 522 and 524 located at either end and in the middle of a channel 11 formed in a piezoelectric body 530. Channel walls are separated by a gap 540 into two sections 550,560 supplied by ports 520,522 and 522,524 respectively, with each section being independently actuable by means of respective electrodes 570, 580 driven by drive circuits (not shown) via conductive tracks 650,660. For each section there is provided a respective nozzle 610,620 formed in a nozzle plate 615 and communicating with a section of the channel 11 via communication holes 630,640 formed in the bottom surface of the channel at points located midway between the respective inlet ports for that section.

Such a configuration is described in co-pending UK patent application no. 9710530.8 and results in a printhead having two parallel rows of independently actuable printing elements that is compact and which has a reduced actuating voltage per unit droplet ejection velocity due to the "double-ended" ink supply to each channel section.

Unlike earlier embodiments, the conductive tracks 650, 660 that electrically connect the channel electrodes to the drive chips are formed on the piezoelectric body itself, advantageously in the same step in which the electrodes 570, 580 are deposited on the channel walls. Such an arrangement is known from EP-A-0 397 441 and consequently will not be described in further detail here. Connection between track 650, 660 and drive chip 590, 600 may be achieved by any conventional method, including wire bonding or gold ball connection.

Figure 8:
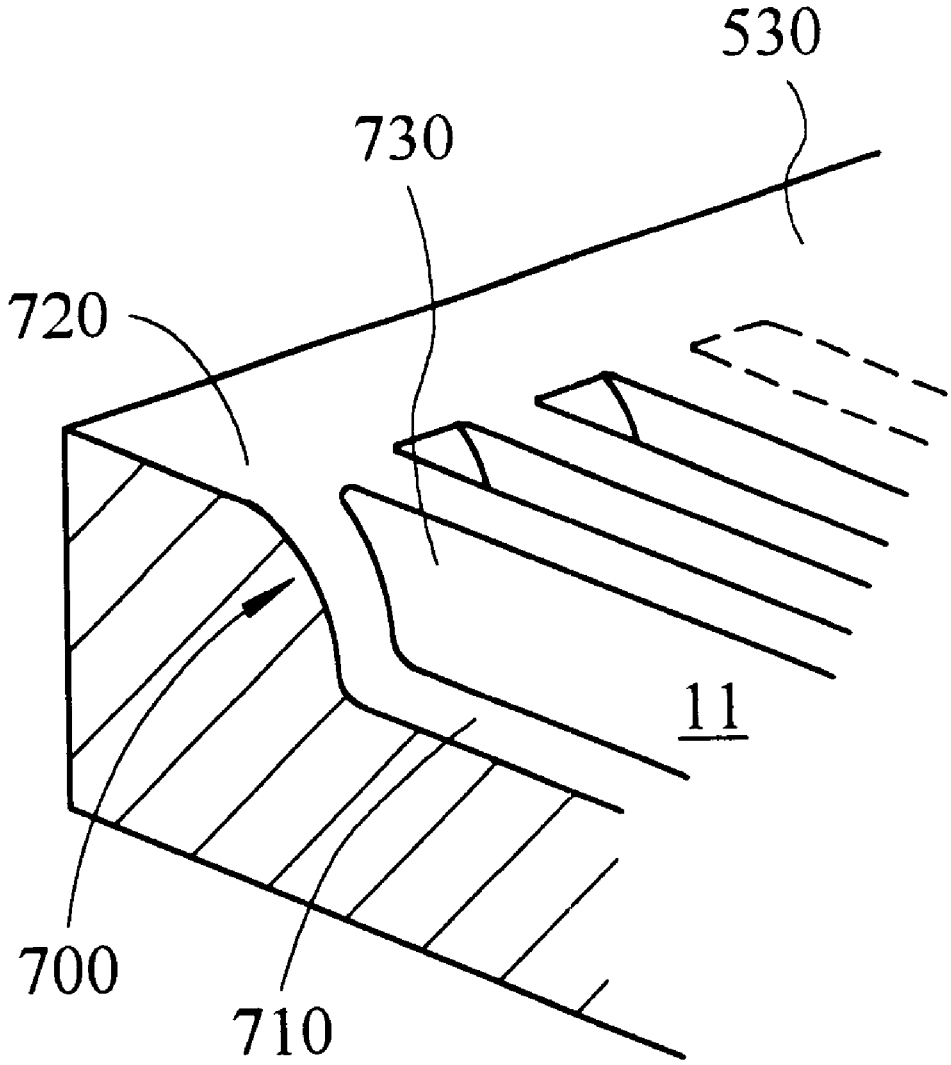
FIG. 8 is a detail perspective view of the end of the piezoelectric body of the printhead of FIG. 7.

Piezoelectric body 530 may be moulded: in addition to having clear manufacturing advantages, such a process permits the end of the channel 11 to be formed as illustrated in FIG. 8, namely with a smooth, continuous transition 700 from the top surface 720 of the body to both the channel wall 730 and the bottom, longitudinal surface 710 of the channel. This in turn avoids discontinuities in the subsequently-deposited electrode material and the associated heating effects which might have a deleterious effect on the operational life of the printhead as a whole.

Figure 9:
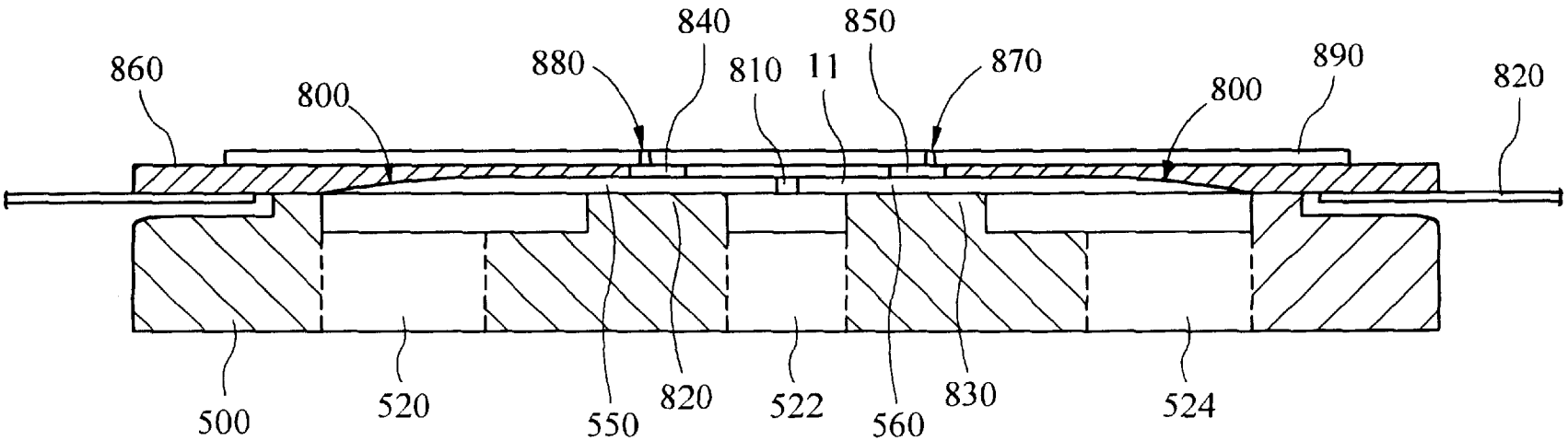
FIGS. 9 and 10 are sectional and detail sectional views respectively of an alternative embodiment of the printhead shown in FIG. 7.
Figure 10:
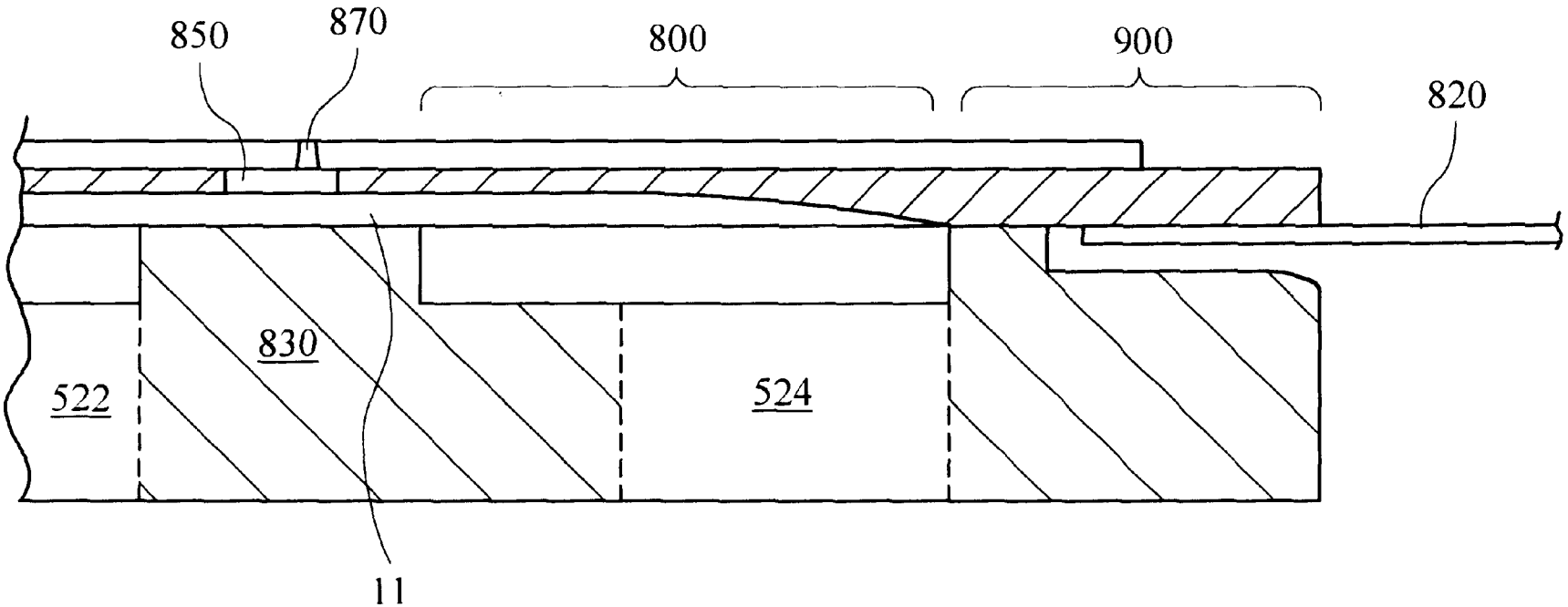

Alternatively, channels may be formed in the piezoelectric component by sawing using a disc cutter—as described e.g. in EP-A-0 309 148—and illustrated in the sectional and detail sectional views of FIGS. 9 and 10. It follows that the depth of the channel 11 will run out more gradually at each end, as shown at 800, and that the piezoelectric channel wall defined between adjacent sawn channels 11 will run continuously between the two active sections 550,560. However, a break 810 in the electrodes on the channel walls at a location between the two sections ensures that each the wall in active section can be actuated independently by signals supplied via electrical input 820. Such a break may be achieved e.g. by masking during deposition of the metal plating or by removal of the plating by a laser.

Connection between the electrodes on the channel walls and the electrical input 820, whilst not shown in detail, may be achieved by any of the known techniques including wire bond between tracks formed in shallow "run-out" grooves formed in the area 900 rearward of the channel 11 (described in the aforementioned EP-A-0 364 136) or conductive adhesive (e.g. anisotropic conductive adhesive) between conductive tracks formed in area 900 on the surface of the piezoelectric sheet itself and (described in EP-A-0 397 441).

As in the embodiment of FIG. 7, each channel 11 is closed along its two active sections 550, 560 by appropriate lengths 820, 830 of a cover component 500 which is also formed with ports 520, 522, 540 that allow ink to be supplied to each channel active section and, optionally, allow ink to be circulated through each channel section for cleaning purposes, s is generally known. Ports may be positioned so as to define the edge of an active section, as in the case of port 522, in which case manufacture is simplified. In the example shown, the width of cover port 522 and the cover closing lengths 820, 830 are of the same order of magnitude, typically 2 mm.

Ink ejection from each active section is again via openings that communicate the channel with the opposite surface of the piezoelectric component (sheet 860) to that in which the channel is formed. In the present embodiment, these openings take the form of slots 840,850 which extend some distance—typically 200 $\mu$m—in the longitudinal direction of the channel so as to allow some leeway in the placing of the respective nozzles 870,880 in nozzle plate 890. Offsetting of nozzles is generally necessary whenever simultaneous droplet ejection from adjacent channels is not possible e.g. in "shared wall" printheads of the kind illustrated, is generally known e.g. from EP-A-0 376, and will not therefore be discussed in any greater detail.

Printheads according to the present invention may also be made in a modular format as described in the aforementioned WO91/17051, each module being formed in opposite end surfaces thereof with respective channel parts so that, upon butting together of modules, further channels are formed between respective pairs of butted modules. In such arrangements, the respective channel parts may include at least part of a slot formed in the channel base and of sufficient length that, even if a pair of butted modules and their respective slot parts are not perfectly aligned, there remains an overlap between the two slot halves sufficient to accommodate a nozzle.

As in the previous embodiment, nozzles 870,880 are formed in a nozzle plate 890 which, as illustrated, may extend over the substantially the entire length of piezoelectric sheet 860 so as to provide a suitably large area for engagement e.g. of a capping and/or wiping mechanism.

It should be understood that this invention has been described by way of examples only and that a wide variety of modifications can be made without departing from the scope of the invention. Features shown in the context of the first aspect of the invention may be equally applicable to the second aspect and vice versa.

The piezoelectric channel walls, for example, can be polarised in opposite directions normal to the plane of the channel axes as known, for example, from EP-A-0 277 703. Alternatively, polarisation of the channel walls can be parallel to the plane of the channel axes with electrodes formed in the channel walls themselves as known, for example, from EP-A-0 528 647.

Nor is every channel in a printhead required to be capable of droplet ejection: active channels capable of droplet ejection may be alternated in the printhead with inactive—so-called "dummy" channels—as described, for example, in the aforementioned EP-A-0 277 703.

What is claimed is:

1. Droplet deposition apparatus comprising:

at least one longitudinal, open-topped droplet liquid channel defined by facing longitudinal side walls and a bottom, longitudinal surface extending between the side walls;

means for applying an electric field to a piezoelectric material in at least a wall of said walls, thereby to effect displacement of the wall relative to said longitudinal channel so as to eject a droplet from the channel; and a cover closing the open, longitudinal top of the channel;

wherein said bottom longitudinal surface of the channel is formed with an opening for droplet ejection, and;

the cover incorporates two ports for supply of droplet liquid, the ports being spaced along the channel on either side of the opening.

2. Apparatus according to 1, wherein the supply ports are spaced on either side of the opening by an equal amount.

3. Apparatus according to claim 1, wherein the bottom longitudinal surface of the channel is formed with at least two openings, the openings being spaced along the channel.

4. Apparatus according to claim 3, wherein the cover incorporates droplet supply ports spaced along the channel so as to lie either side of each opening.

5. Apparatus according to claim 1, wherein the piezoelectric material deforms in shear mode when subject to the electric field.

6. Apparatus according to claim 1, wherein an electrode is formed on a channel-facing surface of the channel wall.

7. Apparatus according to claim 6, wherein an electrode is also formed on the channel wall on a surface opposed to the channel-facing surface of the channel wall.

8. Apparatus according to claim 1, wherein said channel wall is displaceable in response to electrical signals in a direction transverse to the axes of the channels.

9. Apparatus according to claim 1, wherein said bottom, longitudinal surface is defined by a base, said base and said longitudinal side walls being integral.

10. Apparatus according to claim 1 and including a plurality of longitudinal channels arranged parallel to one another.

11. Droplet deposition apparatus comprising:

at least one longitudinal, open-topped droplet liquid channel defined by facing longitudinal side walls and a bottom, longitudinal surface extending between the side walls;

means for supplying droplet liquid to the channel;

means for applying an electric field to piezoelectric material in at least one of said walls, thereby to effect displacement of the wall relative to said longitudinal channel so as to eject a droplet from the channel; and a cover closing the open, longitudinal top side of the channel;

wherein the bottom longitudinal surface of the channel is formed with two openings for droplet ejection, the openings being spaced along the channel.

12. Apparatus according to claim 11, wherein the means for supplying droplet liquid comprises supply ports in the cover, spaced along the channel so as to lie either side of each opening.

13. Apparatus according to claim 11, wherein the piezoelectric material deforms in shear mode when subject to the electric field.

14. Apparatus according to claim 11, wherein an electrode is formed on a channel-facing surface of the channel wall.

15. Apparatus according to claim 14, wherein an electrode is also formed on the channel wall on a surface opposed to the channel-facing surface of the channel wall.

16. Apparatus according to claim 11, wherein said channel wall is displaceable in response to electrical signals in a direction transverse to the axes of the channels.

17. Apparatus according to claim 11, wherein said bottom, longitudinal surface is defined by a base, said base and said longitudinal side walls being integral.

18. Apparatus according to claim 11 and including a plurality of longitudinal channels arranged parallel to one another.

19. Droplet deposition apparatus comprising at least one channel having means for communicating with a supply of droplet liquid and an opening for ejection of droplets;

the channel being bounded on at least one side lying parallel to the channel axis by a channel wall associated with actuator means; the actuator means effecting displacement of the channel wall in response to electrical signals, thereby to effect ejection of droplets from the channel;

the channel being bounded on a further side lying parallel to the channel axis by a cover surface, the cover surface having formed thereon at least one conductive track for conveying electrical signals to said actuator means, the point of electrical connection between the track and the actuator means lying outside the channel.

20. Apparatus according to claim 19, wherein the point of electrical connection is sealed from ingress of droplet fluid from the channel.

21. Apparatus according to claim 19, wherein an area adjacent said channel has an electrically-conductive coating which is in electrical contact with the actuator means associated with at least one channel wall of said channel, the conductive track being in electrical contact with said electrically-conductive coating.

22. Apparatus according to claim 21, wherein said area is a groove.

23. Apparatus according to claim 22, wherein the groove is of lesser depth than the channel.

24. Apparatus according to claim 22, wherein the groove is co-linear with the channel.

25. Apparatus according to claim 21, wherein a protective coating is applied to the channel wall.

26. Apparatus according to claim 25 and wherein said electrically-conductive coating further extends over at least a channel-facing surface of the channel wall, the protective coating being applied to said electrically-conductive coating.

27. Apparatus according to claim 25, wherein the protective coating terminates in said area adjacent said channel.

28. Apparatus according to claim 19, wherein the electrical contact is made by a deformable conductive material interposed between the electrically-conductive coating and the conductive track.

29. Apparatus according to claim 28, wherein the deformable conductive material is solder.

30. Apparatus according to claim 19, wherein the tops of said channel walls are attached to the cover surface by a non-conducting bond.

31. Apparatus according to claim 30, wherein the non-conductive bond is an adhesive bond.

32. Apparatus according to claim 19, wherein a plurality of channels are formed in an array, the channels lying parallel to one another and defining channel walls therebetween.

33. Apparatus according to claim 32, wherein said channel walls are displaceable in response to electrical signals in a direction transverse to the axes of the channels and parallel to the channel array direction.

34. Apparatus according to claim 19, wherein the channel wall comprises piezoelectric material to which said electrical signals are applied.

35. Apparatus according to claim 34, wherein said piezoelectric material deforms in shear mode when subject to said electrical signals.

36. Apparatus according to claim 35, wherein an electrode is formed on a channel-facing surface of the channel wall and the piezoelectric material is polarised in a direction perpendicular both to the array direction and to the channel axis.

37. Apparatus according to claim 19, wherein the body comprises a sheet of piezoelectric material, the plurality of channels being formed in one surface of the sheet.

38. Apparatus according to claim 37, wherein the piezoelectric material is polarised in a direction normal to the surface of the sheet.

39. Apparatus according to claim 19, wherein said cover is formed with ports for supply of droplet liquid into said channel.

40. Droplet deposition apparatus comprising:

a bottom sheet of piezo-material poled in a direction normal to said sheet and formed with a multiplicity of parallel, open-topped channels mutually spaced in an array direction normal to the length of the channels and defined each by facing side walls and a bottom surface extending between said side walls;

a top sheet facing said bottom surfaces of said channels and bonded to said side walls to close said channels at the tops thereof;

respective nozzles communicating with said channels for the ejection of droplets of liquid therefrom;

connection means for connecting said channels with a source of droplet deposition liquid;

wherein each channel is formed with a forward part in which electrodes are provided on opposite sides of at least one of the side wails defining the channel, thereby to form a shear mode actuator for effecting droplet expulsion from the channel; and wherein each channel is formed with a rearward part having an electrically-conductive coating which is in electrical contact with the at least one electrode on the channel-facing sides of the side walls in the forward part;

sealing means separating the forward part from the rearward part; and wherein the apparatus further comprises conductive tracks formed on that surface of said top sheet that is bonded to said side walls, the conductive tracks being in electrical contact with the electrically-conductive coating in said rearward part.

41. Apparatus according to claim 22, wherein the groove is sealed by sealing means against ingress of droplet fluid from the channel.

42. Appparatus according to claim 41, wherein said sealing means extends over the termination of the protective coating in said area adjacent said channel.

* * * * *

UNITED STATES PATENT AND TRADEMARK OFFICE

CERTIFICATE OF CORRECTION

PATENT NO. : 6,572,221 B1
DATED : June 3, 2003
INVENTOR(S) : Robert A. Harvey et al.

It is certified that error appears in the above-identified patent and that said Letters Patent is hereby corrected as shown below:

Column 1,
Line 7, please delete "January 19, 1998" and insert -- January 29, 1998 --

Column 2,
Line 23, please delete "channels, thereafter," and insert -- channels. Thereafter, --

Column 5,
Line 23, please delete "know" and insert -- known --

Column 8,
Lines 8-9, please delete "each the wall in active" and insert -- each wall in the active --
Line 28, please delete "s is" and insert -- as is --
Line 62, please delete "over the substantially" and -- over substantially --

Column 12,
Line 18, please delete "wails" and insert -- walls --

Signed and Sealed this

Eighth Day of March, 2005

JON W. DUDAS
*Director of the United States Patent and Trademark Office*